US008616247B2

(12) United States Patent
Hopkinson et al.

(10) Patent No.: US 8,616,247 B2
(45) Date of Patent: Dec. 31, 2013

(54) METHODS AND APPARATUS FOR FORMING A CABLE MEDIA

(75) Inventors: Wayne Hopkinson, Hickory, NC (US); Trent Hayes, Hickory, NC (US); Borivoje Antonijevic, Westlake (AU); Craig Masters, Petrie (AU); Ross Beames, Sherwood (AU); Eamonn Wyer, Dublin (IE); Robert Black, Kilcoole (IE)

(73) Assignee: CommScope, Inc. of North Carolina, Durham, NC (US)

( * ) Notice: Subject to any disclaimer, the term of this patent is extended or adjusted under 35 U.S.C. 154(b) by 997 days.

(21) Appl. No.: 12/128,047

(22) Filed: May 28, 2008

(65) Prior Publication Data

US 2009/0000688 A1 Jan. 1, 2009

Related U.S. Application Data

(60) Division of application No. 10/943,497, filed on Sep. 17, 2004, now Pat. No. 7,392,647, which is a continuation-in-part of application No. 10/690,608, filed on Oct. 23, 2003, now Pat. No. 6,875,928.

(51) Int. Cl.
*B21F 15/04* (2006.01)

(52) U.S. Cl.
USPC ..... 140/118; 140/149; 57/237

(58) Field of Classification Search
USPC ..... 140/118–120, 149
See application file for complete search history.

(56) References Cited

U.S. PATENT DOCUMENTS

| | | | | |
|---|---|---|---|---|
| 2,835,283 | A | | 5/1958 | Thone et al. |
| 3,379,000 | A | * | 4/1968 | Webber et al. ..... 57/243 |
| 3,763,899 | A | * | 10/1973 | Orlandi ..... 140/149 |
| 3,945,182 | A | | 3/1976 | Dover et al. |
| 4,235,070 | A | | 11/1980 | Bravin |
| 4,873,393 | A | | 10/1989 | Friesen et al. |

(Continued)

FOREIGN PATENT DOCUMENTS

| | | | |
|---|---|---|---|
| EP | 2 131 370 | A1 | 12/2009 |
| GB | 2353895 | A | 3/2001 |

(Continued)

OTHER PUBLICATIONS

First Chinese Office Action (18 pages) corresponding to Chinese Patent Application No. 200510104030.8; Mailing Date: Mar. 27, 2009.

(Continued)

*Primary Examiner* — Dana Ross
*Assistant Examiner* — Matthew G Katcoff
(74) *Attorney, Agent, or Firm* — Myers Bigel Sibley & Sajovec

(57) ABSTRACT

A method for forming a cabling media includes providing a wire pair including first and second conductor members. Each of the first and second conductor members includes a respective conductor and a respective insulation cover surrounding the conductor thereof. The first and second conductor members are twisted about one another to form a twisted wire pair having a twist length that purposefully varies along a length of the twisted wire pair. The method may include: imparting a purposefully varied pretwist to the wire pair using a wire pair twist modulator; and imparting additional twist to the wire pair using a wire pair twisting device downstream of the wire pair twist modulator.

16 Claims, 10 Drawing Sheets

(56) References Cited

U.S. PATENT DOCUMENTS

| | | | | |
|---|---|---|---|---|
| 5,644,909 | A | 7/1997 | Knoff et al. | |
| 5,729,966 | A * | 3/1998 | Grulick | 57/293 |
| 5,739,473 | A | 4/1998 | Zerbs | |
| 5,767,441 | A | 6/1998 | Brorein et al. | |
| 5,931,203 | A * | 8/1999 | Kredler et al. | 140/149 |
| 5,952,607 | A | 9/1999 | Friesen et al. | |
| 5,966,917 | A | 10/1999 | Thompson | |
| 6,167,687 | B1 * | 1/2001 | Thompson | 57/58.49 |
| 6,254,924 | B1 * | 7/2001 | Brorein et al. | 427/117 |
| 6,270,598 | B1 * | 8/2001 | Kasahara et al. | 156/47 |
| 6,318,062 | B1 | 11/2001 | Doherty | |
| 6,378,283 | B1 | 4/2002 | Barton | |
| 6,430,913 | B1 | 8/2002 | Gentry et al. | |
| 6,959,533 | B2 | 11/2005 | Noel et al. | |
| 7,115,815 | B2 | 10/2006 | Kenny et al. | |
| 2002/0174642 | A1 * | 11/2002 | Gentry et al. | 57/7 |
| 2003/0126851 | A1 | 7/2003 | Noel, Jr. et al. | |
| 2005/0034443 | A1 | 2/2005 | Cook | |
| 2008/0077258 | A1 * | 3/2008 | Shoham | 700/90 |

FOREIGN PATENT DOCUMENTS

| | | | |
|---|---|---|---|
| JP | 44-4274 | | 2/1969 |
| JP | 47-51791 | | 12/1972 |
| JP | 61-256510 | | 11/1986 |
| JP | 62-216110 | | 9/1987 |
| JP | 6-349344 | | 12/1994 |
| JP | 6-349344 | A2 | 12/1994 |
| JP | 8-102229 | | 4/1996 |
| JP | 10-247424 | | 9/1998 |
| JP | 10-257424 | A | 9/1998 |
| JP | 2001-297637 | | 10/2001 |
| WO | WO 00/67263 | A1 | 11/2000 |
| WO | WO 00/74079 | A1 | 12/2000 |

OTHER PUBLICATIONS

Extended European Search Report (8 pages) corresponding to European Patent Application No. 05014669.5; Mailing Date: Apr. 9, 2009.

U.S. Appl. No. 10/680,156, filed Oct. 8, 2003, titled "Tightly Twisted Wire Pair Arrangement for Cabling Media", inventors Hayes et al.

U.S. Appl. No. 10/690,680, filed Oct. 23, 2003, titled "Local Area Network Cabling Arrangement with Randomized Variation", inventors Hayes et al.

Korean Office Action for corresponding application 10-2005-82163, dated Apr. 26, 2010.

Translation of Japanese Office Action Corresponding to Patent Application No. 2006-536915; Dated: Nov. 30, 2011; 7 pages.

European Search Report corresponding to Application No. 10194059.1-1251, Dated Jun. 28, 2012, 7 pages.

English translation of Japanese Office Action Corresponding to U.S. Appl. No. 10/690,608; Dated: Jun. 20, 2012; 6 pages.

Japanese Office Action Corresponding to Japanese Patent Application No. 2005-269640; Dispatch Date: Jul. 27, 2012; Foreign Text, 5 Pages, English Translation Thereof, 5 Pages.

* cited by examiner

METHODS AND APPARATUS FOR FORMING A CABLE MEDIA

RELATED APPLICATION(S)

The present application is a divisional application of and claims priority from U.S. patent application Ser. No. 10/943,497, filed Sep. 17, 2004, now U.S. Pat. No. 7,392,647 which is a continuation-in-part (CIP) application of and claims priority from U.S. patent application Ser. No. 10/690,608, filed Oct. 23, 2003, now U.S. Pat. No. 6,875,928.

FIELD OF THE INVENTION

The present invention relates to cabling media including twisted wire pairs and, more particularly, to methods and apparatus for forming cabling media including twisted wire pairs.

BACKGROUND OF THE INVENTION

Along with the greatly increased use of computers for homes and offices, there has developed a need for a cabling media, which may be used to connect peripheral equipment to computers and to connect plural computers and peripheral equipment into a common network. Today's computers and peripherals operate at ever increasing data transmission rates. Therefore, there is a continuing need to develop cabling media that can operate substantially error-free at higher bit rates, but that can also satisfy numerous elevated operational performance criteria, such as a reduction in alien crosstalk when the cable is in a high cable density application.

Co-pending, co-owned U.S. patent application Ser. No. 10/690,608, filed Oct. 23, 2003, entitled "LOCAL AREA NETWORK CABLING ARRANGEMENT WITH RANDOMIZED VARIATION," issued as U.S. Pat. No. 6,875,928, the disclosure of which is incorporated herein by reference in its entirety, discloses cabling media including a plurality of twisted wire pairs housed inside a jacket. Each of the twisted wire pairs has a respective twist length, defined as a distance wherein the wires of the twisted wire pair twist about each other one complete revolution. At least one of the respective twist lengths purposefully varies along a length of the cabling media. In one embodiment, the cabling media includes four twisted wire pairs, with each twisted wire pair having its twist length purposefully varying along the length of the cabling media. Further, the twisted wire pairs may have a core strand length, defined as a distance wherein the twisted wire pairs twist about each other one complete revolution. In a further embodiment, the core strand length is purposefully varied along the length of the cabling media. The cabling media can be designed to meet the requirements of CAT 5, CAT 5e or CAT 6 cabling, and demonstrates low alien and internal crosstalk characteristics even at data bit rates of 10 Gbit/sec.

SUMMARY OF THE INVENTION

According to method embodiments of the present invention, a method for forming a cabling media includes providing a wire pair including first and second conductor members. Each of the first and second conductor members includes a respective conductor and a respective insulation cover surrounding the conductor thereof. The first and second conductor members are twisted about one another to form a twisted wire pair having a twist length that purposefully varies along a length of the twisted wire pair. The method may include: imparting a purposefully varied pretwist to the wire pair using a wire pair twist modulator; and imparting additional twist to the wire pair using a wire pair twisting device downstream of the wire pair twist modulator.

According to further method embodiments of the present invention, a method for forming a cabling media includes providing a first twisted wire pair including first and second conductor members and a second twisted wire pair including third and fourth conductor members. Each of the first, second, third and fourth conductor members includes a respective conductor and a respective insulation cover surrounding the conductor thereof. The first and second twisted wire pairs are twisted about one another to form a twisted core having a twist length that purposefully varies along a length of the twisted core. The method may include: imparting a purposefully varied pretwist to the first and second twisted wire pairs using a core twist modulator; and imparting additional twist to the first and second twisted wire pairs using a core twisting device downstream of the wire pair twist modulator.

According to further embodiments of the present invention, an apparatus for forming a cabling media using a wire pair including first and second conductor members, each of the first and second conductor members including a respective conductor and a respective insulation cover surrounding the conductor thereof, is provided. The apparatus is adapted to twist the first and second conductor members about one another to form a twisted wire pair having a twist length that purposefully varies along a length of the twisted wire pair. The apparatus may include a wire pair twist modulator adapted to impart a purposefully varied pretwist to the wire pair, and a wire pair twisting device downstream of the wire pair twist modulator, wherein the wire pair twisting device is adapted to impart additional twist to the wire pair.

According to further embodiments of the present invention, an apparatus for forming a cabling media using a first twisted wire pair including first and second conductor members and a second twisted wire pair including third and fourth conductor members, each of the first, second, third and fourth conductor members including a respective conductor and a respective insulation cover surrounding the conductor thereof, is provided. The apparatus is adapted to twist the first and second twisted wire pairs about one another to form a twisted core having a twist length that purposefully varies along a length of the twisted core. The apparatus may include a core twist modulator adapted to impart a purposefully varied pretwist to the first and second twisted wire pairs, and a core twisting device downstream of the core twist modulator, wherein the core twisting device is adapted to impart additional twist to the first and second twisted wire pairs.

According to further embodiments of the present invention, a wire pair twist modulator for forming a cabling media using a wire pair including first and second conductor members, each of the first and second conductor members including a respective conductor and a respective insulation cover surrounding the conductor thereof, is provided. The wire pair twist modulator is adapted to impart a purposefully varied twist to the wire pair. The wire pair twist modulator may include an engagement member adapted to engage the wire pair and rotationally oscillate about a twist axis.

According to still further embodiments of the present invention, a core twist modulator for forming a cabling media using a first twisted wire pair including first and second conductor members and a second twisted wire pair including third and fourth conductor members, each of the first, second, third and fourth conductor members including a respective conductor and a respective insulation cover surrounding the conductor thereof, is provided. The core twist modulator is adapted to impart a purposefully varied twist to the first and second twisted wire pairs. The core twist modulator may include an engagement member adapted to engage the first and second twisted wire pairs and rotationally oscillate about a twist axis.

Objects of the present invention will be appreciated by those of ordinary skill in the art from a reading of the figures and the detailed description of the illustrative embodiments which follow, such description being merely illustrative of the present invention.

BRIEF DESCRIPTION OF THE DRAWINGS

The accompanying drawings, which are incorporated in and constitute a part of the specification, illustrate some embodiments of the invention and, together with the description, serve to explain principles of the invention.

DETAILED DESCRIPTION OF EMBODIMENTS OF THE INVENTION

The present invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout the description. It will be understood that, as used herein, the term "comprising" or "comprises" is open-ended, and includes one or more stated elements, steps and/or functions without precluding one or more unstated elements, steps and/or functions. As used herein, the term "and/or" includes any and all combinations of one or more of the associated listed items. Except where noted herein, designations of "first, "second," "third," etc. do not indicate an order or hierarchy of steps or elements.

In the description of the present invention that follows, the term "downstream" is used to indicate that certain material (e.g., a conductor member or twisted wire pair) traveling or being acted upon is farther along in the process than other material. Conversely, the term "upstream" refers to the direction opposite the downstream direction.

Figure 1:
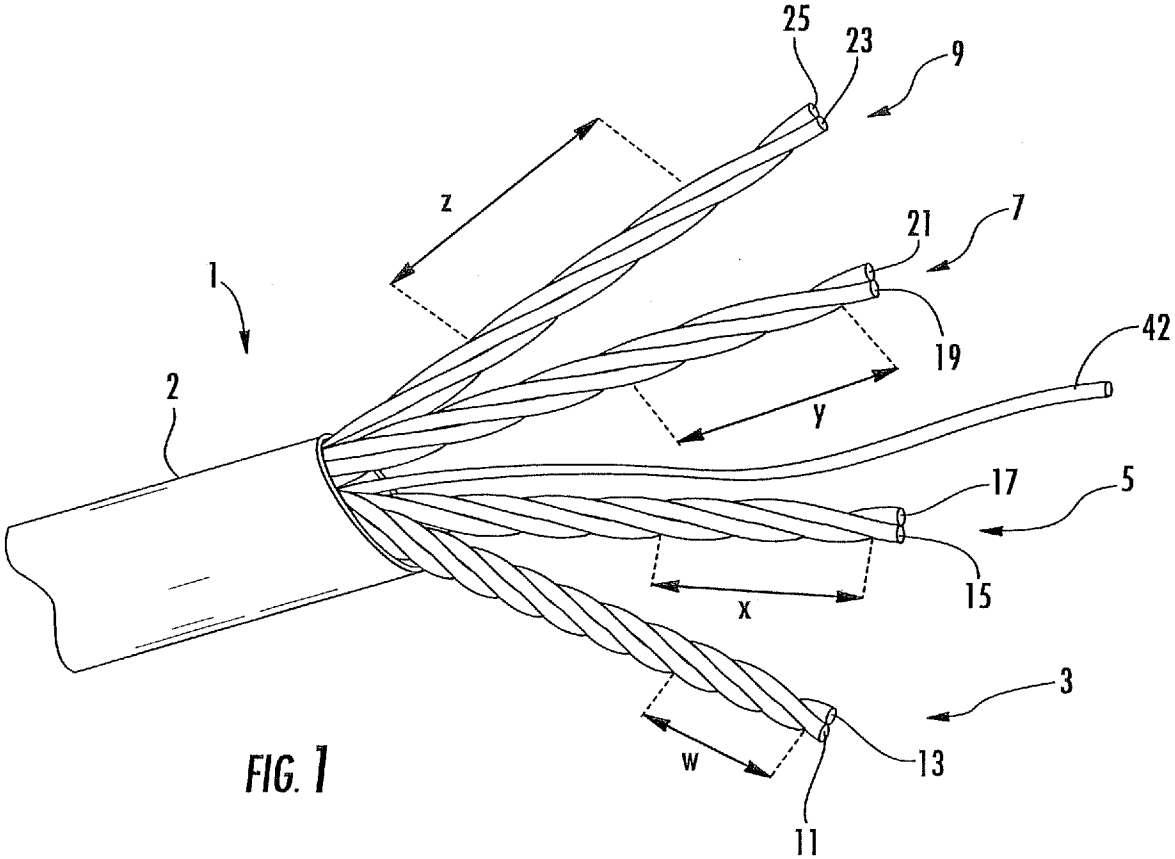
FIG. 1 is a perspective view of a cable according to embodiments of the present invention, wherein a jacket thereof is partially removed to show four twisted wire pairs and a separator of the cable.

FIG. 1 illustrates an exemplary cabling media or cable 1 which may be formed using apparatus and/or methods in accordance with the present invention. The end of the cable 1 has a jacket 2 removed to show a plurality of twisted wire pairs. Specifically, the embodiment of FIG. 1 illustrates the cable 1 having a first twisted wire pair 3, a second twisted wire pair 5, a third twisted wire pair 7, and a fourth twisted wire pair 9. The cable 1 also includes a separator or strength member 42. The separator 42 may be formed of a flexible, electrically insulative material such as polyethylene, for example.

Each twisted wire pair includes two conductor members. Specifically, the first twisted wire pair 3 includes a first conductor member 11 and a second conductor member 13. The second twisted wire pair 5 includes a third conductor member 15 and a fourth conductor member 17. The third twisted wire pair 7 includes a fifth conductor member 19 and a sixth conductor member 21. The fourth twisted wire pair 9 includes a seventh conductor member 23 and an eighth conductor member 25.

Each of the conductor members 11, 13, 15, 17, 19, 21, 23, 25 is constructed of an insulation layer or cover surrounding an inner conductor. The outer insulation layer may be formed of a flexible plastic material having flame retardant and smoke suppressing properties. The inner conductor may be formed of a metal, such as copper, aluminum, or alloys thereof. It should be appreciated that the insulation layer and inner conductor may be formed of other suitable materials. The inner conductor is substantially continuous and elongated. The insulation layer may also be substantially continuous and elongated.

As illustrated in FIG. 1, each twisted wire pair is formed by having its two conductor members continuously twisted around each other. For the first twisted wire pair 3, the first conductor member 11 and the second conductor member 13 twist completely about each other, three hundred and sixty degrees, at a first interval w along the length of the first cable 1. The first interval w purposefully varies along the length of the first cable 1. For example, the first interval w could purposefully vary randomly within a first range of values along the length of the first cable 1. Alternatively, the first interval w could purposefully vary in accordance with an algorithm along the length of the first cable 1.

For the second twisted wire pair 5, the third conductor member 15 and the fourth conductor member 17 twist completely about each other, three hundred and sixty degrees, at a second interval x along the length of the first cable 1. The second interval x purposefully varies along the length of the first cable 1. For example, the second interval x could purposefully vary randomly within a second range of values along the length of the first cable 1. Alternatively, the second interval x could purposefully vary in accordance with an algorithm along the length of the first cable 1.

For the third twisted wire pair 7, the fifth conductor member 19 and the sixth conductor member 21 twist completely about each other, three hundred and sixty degrees, at a third interval y along the length of the first cable 1. The third interval y purposefully varies along the length of the first cable 1. For example, the third interval y could purposefully vary randomly within a third range of values along the length of the first cable 1. Alternatively, the third interval y could purposefully vary in accordance with an algorithm along the length of the first cable 1.

For the fourth twisted wire pair 9, the seventh conductor member 23 and the eighth conductor member 25 twist completely about each other, three hundred and sixty degrees, at a fourth interval z along the length of the first cable 1. The fourth interval z purposefully varies along the length of the first cable 1. For example, the fourth interval z could purposefully vary randomly within a fourth range of values along the length of the first cable 1. Alternatively, the fourth interval z could purposefully vary in accordance with an algorithm along the length of the first cable 1.

Due to the randomness of the twist intervals, it is remarkably unlikely that the twist intervals of an adjacent second cable, even if constricted in the same manner as the cable 1, would have the same randomness of twists for the twisted wire pairs thereof as the twisted wire pairs 3, 5, 7, 9 of the first cable 1. Alternatively, if the twists of the twisted wire pairs are set by an algorithm, it would remarkably unlikely that a segment of the second cable having the twisted wire pairs would lie alongside a segment of the first cable 1 having the same twist pattern of the twisted wire pairs 3, 5, 7, 9.

Each of the twisted wire pairs 3, 5, 7, 9 has a respective second, third and fourth mean value within the respective first, second, third and fourth ranges of values. In one embodiment, each of the first, second, third and fourth mean values of the intervals of twist w, x, y, z is unique. For example, in one of many embodiments, the first mean value of the first interval of twist w is about 0.44 inches; the second mean value of second interval of twist x is about 0.41 inches; the third mean value of the third interval of twist y is about 0.59 inches; and the fourth mean of the fourth interval of twist z is about 0.67 inches. In one of many embodiments, the first, second, third and fourth ranges of values for the first, second, third and fourth intervals of twisted extend +/−0.05 inches from the mean value for the respective range, as summarized in the table below:

| Pair No. | Mean Twist Length | Lower Limit of Twist Length | Upper Limit of Twist Length |
|---|---|---|---|
| 3 | 0.440 | 0.390 | 0.490 |
| 5 | 0.410 | 0.360 | 0.460 |
| 7 | 0.596 | 0.546 | 0.646 |
| 9 | 0.670 | 0.620 | 0.720 |

By purposefully varying the results of twist w, x, y, z along the length of the cabling media 1, it is possible to reduce internal near end crosstalk (NEXT) and alien near end crosstalk (ANEXT) to an acceptable level, even at high speed data bit transfer rates over the first cable 1.

By the purposefully varying or modulating the twist intervals w, x, y, z, the interference signal coupling between adjacent cables can be randomized. In other words, assume a first signal passes along a twisted wire pair from one end to another end of a cable, and the twisted wire pair has a randomized, or at least varying, twist pattern. It is highly unlikely that an adjacent second signal, passing along another twisted wire (whether within the same cable or within a different cable), will travel for any significant distance alongside the first signal in a same or similar twist pattern. Because the two adjacent signals are traveling within adjacent twisted wire pairs having different varying twist patterns, any interference coupling between the two adjacent twisted wire patterns can be greatly reduced.

The interference reduction benefits of varying the twist patterns of the twisted wire pairs can be combined with the tight twist intervals disclosed in co-owned U.S. patent application Ser. No. 10/680,156, filed Oct. 8, 2003, entitled "TIGHTLY TWISTED WIRE PAIR ARRANGEMENT FOR CABLING MEDIA," now abandoned, incorporated herein by reference. Under such circumstances, the interference reduction benefits of the present invention can be even more greatly enhanced. For example, the first, second, third and fourth mean values for the first, second, third and fourth twist intervals w, x, y, z may be set at 0.44 inches, 0.32 inches, 0.41 inches, and 0.35 inches, respectively.

At least one set of ranges for the values of the variable twist intervals w, x, y, z has been determined that greatly improves the alien NEXT performance, while maintaining the cable within the specifications of standardized cables and enabling an overall cost-effective production of the cabling media. In the embodiment set forth above, the twist length of each of four pairs is purposefully varied approximately +/−0.05 inches from the respective twisted pair's twist length's mean value. Therefore, each twist length is set to purposefully vary about +/−(7 to 12) % from the mean value of the twist length. It should be appreciated that this is only one embodiment of the invention. It is within the purview of the present invention that more or fewer twisted wire pairs may be included in the cable 1 (such as two pair, twenty five pair, or one hundred pair type cables). Further, the mean values of the twist lengths of respective pairs may be set higher or lower. Even further, the purposeful variation in the twist length may be set higher or lower (such as +/−0.15 inches, +/−0.25 inches, +/−0.5 inches or even +/−1.0 inch, or, alternately stated, the ratio of purposeful variation in the twist length to mean twist length could be set a various ratios such as 20%, 50% or even 75%).

Figure 2:
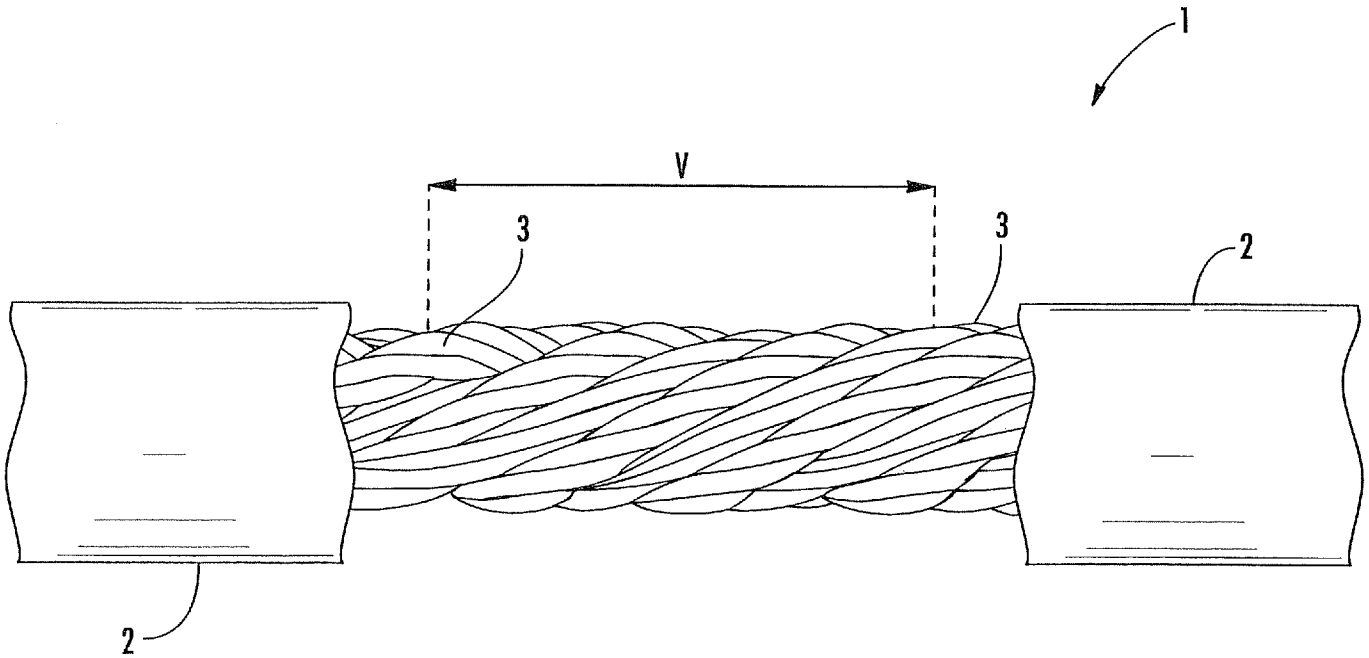
FIG. 2 is an enlarged, fragmentary, side view of the cable of FIG. 1 wherein a portion of the jacket is removed to show a twisted core of the cables.

FIG. 2 is a perspective view of a midsection of the cable 1 of FIG. 1 with the jacket 2 removed. FIG. 2 reveals that the first, second, third and fourth twisted wire pairs 3, 5, 7, 9 are continuously twisted about each other along the length of the first cable 1. The first, second, third and fourth twisted wire pairs 3, 5, 7, 9 twist completely about each other, three hundred sixty degrees, at a purposefully varied core strand length interval v along the length of the cable 1. According to some embodiments, the core strand length interval v has a mean value of about 4.4 inches, and ranges between 1.4 inches and 7.4 inches along the length of the cabling media. The varying of the core strand length can also be random or based upon an algorithm.

The twisting of the twisted wire pairs 3, 5, 7, 9 about each other may serve to further reduce alien NEXT and improve mechanical cable bending performance. As is understood in the art, the alien NEXT represents the induction of crosstalk between a twisted wire pair of a first cabling media (e.g., the first cable 1) and another twisted wire pair of a "different" cabling media (e.g., the second cable 44). Alien crosstalk can become troublesome where multiple cabling media are routed along a common path over a substantial distance. For example, multiple cabling media are often passed through a common conduit in a building. By varying the core strand length interval v along the length of the cabling media, alien NEXT may be further reduced.

Figure 3:
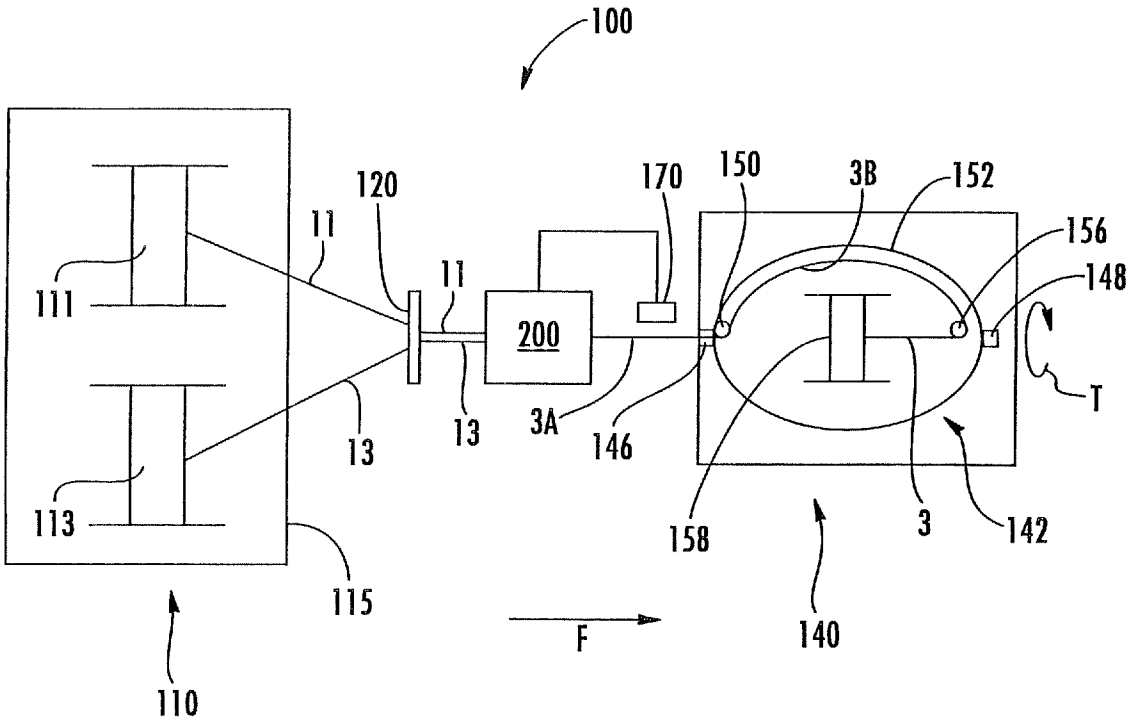
FIG. 3 is a schematic view of a wire pair twisting apparatus according to embodiments of the present invention.

With reference to FIG. 3, a wire pair twisting apparatus 100 according to embodiments of the present invention is shown therein. The wire pair twisting apparatus 100 may be used to form the twisted wire pair 3. The same or similar apparatus may be used to form the twisted wire pairs 5, 7, 9. The wire pair twisting apparatus 100 includes a wire payoff station 110, a guide plate 120, a wire pair twist modulator 200, an encoder 170, and a twinner station 140. The conductor members 11, 13 are conveyed (e.g., drawn) from the wire payoff station 110 to the twinner station 140 in the direction F.

The payoff station 110 includes reels 111, 113 from which the conductor members 11, 13 are paid off to the guide plate 120. The payoff station 110 may have a housing 115. The payoff station 110 may include further mechanisms such as one or more line tensioners, mechanisms to apply a selected constant twist (e.g., a back twist) to the conductor members 11, 13, or the like. Suitable constructions, modifications, and options to and for the payoff station 110 will be apparent to those of skill in the art. Suitable payoff stations 110 include the DVD 630 from Setic of France.

The guide plate 120 may be a simple fixed plate or the like with one or more eyelets to relatively position and align the conductor members 11, 13. Suitable guide plates will be apparent to those of skill in the art from the description herein.

Figure 4:
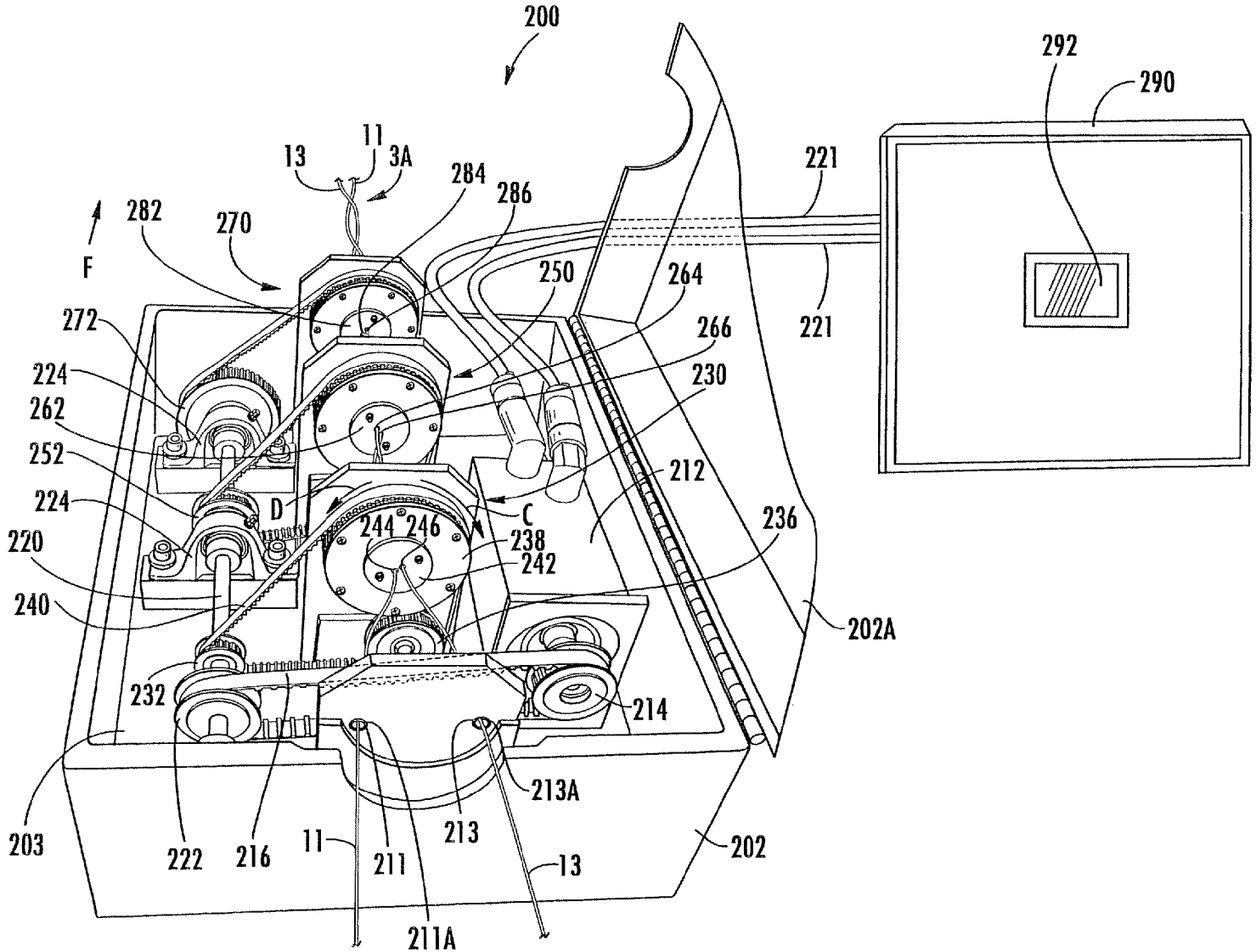
FIG. 4 is a front perspective view of a wire pair twist modulator forming a part of the apparatus of FIG. 3.
Figure 5:
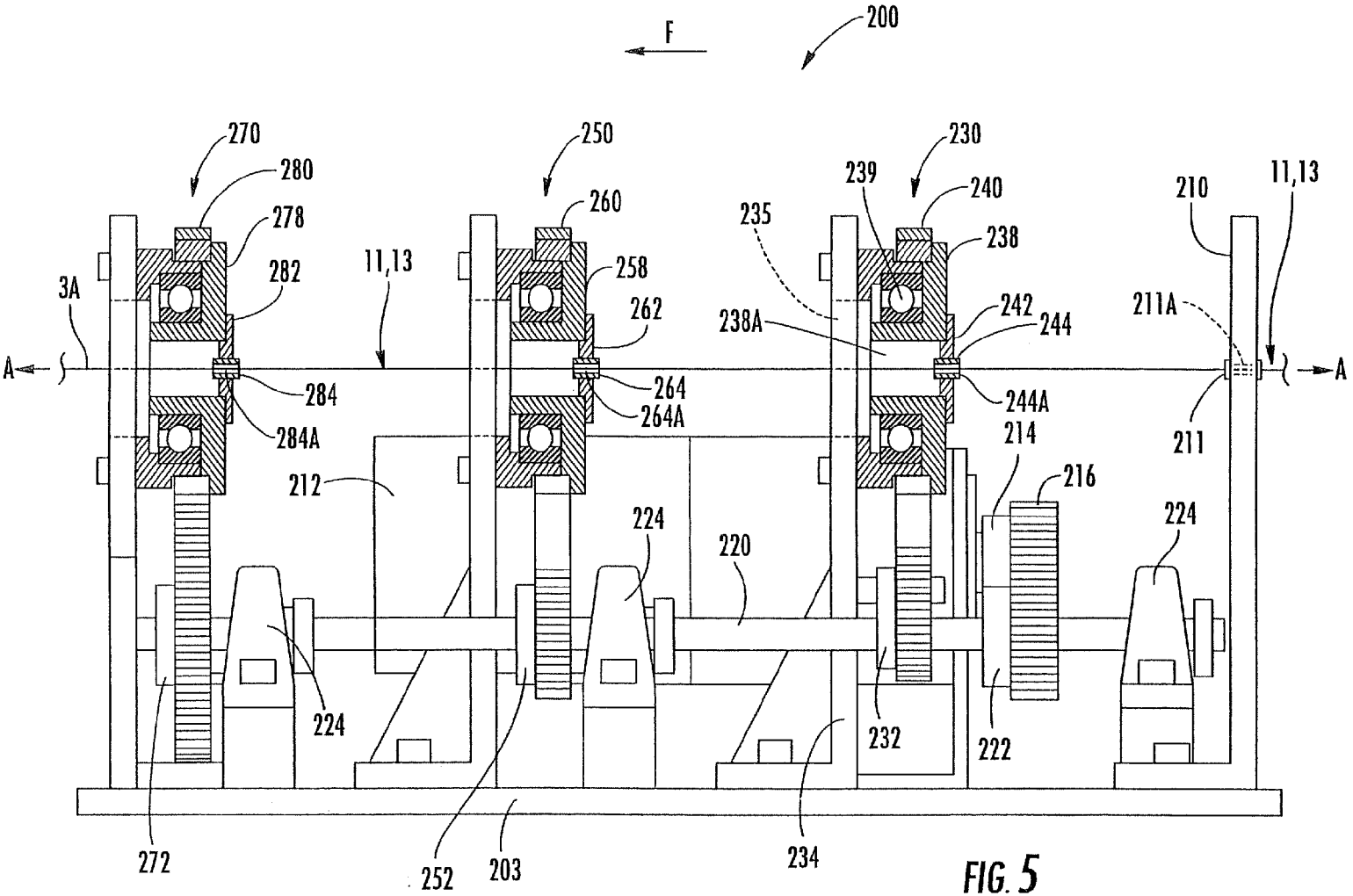
FIG. 5 is a fragmentary, side elevational view of the wire pair twist modulator of FIG. 4.

With reference to FIGS. 4 and 5, the conductor members 11, 13 travel from the guide plate 120 to the wire pair twist modulator 200, where they enter a housing 202 of the modulator 200. The housing 202 may include a closable lid 202A. More particularly, the conductor members 11, 13 enter the modulator 200 through passages 211A, 213A defined in eyelets 211, 213 mounted in a guide plate 210. The eyelets 211, 213 may be formed of a ceramic material, for example. The conductor members 11, 13 are thereafter routed through eyelets of a first modulator subassembly 230, a second modulator subassembly 250, and a third modulator subassembly 270, as discussed below.

The modulator 200 includes a motor 212 having cables 221 to connect the motor 212 to a controller 290. According to some embodiments, the motor 212 is a reversible servomotor. The motor 212 has an output shaft with a motor gear 214. An endless primary drive belt 216 connects the motor gear 214 to a drive shaft 220 via a gear 222 that is affixed to the drive shaft 220. The drive shaft 220 is rotatably coupled to a base 203 by mounts 224, which may include bearings.

The first modulator subassembly 230 includes a mount 234 secured to the base 203. A main gear 238 is mounted on the mount 234 by a bearing 239 for rotation about an axis A-A (FIG. 5). The axis A-A may be substantially parallel to the direction F. A gear 232 is affixed to the drive shaft 220 and an idler pulley 236 (FIG. 4) is rotatably mounted on the mount 234. An endless drive belt 240 extends about the gears 232, 238 and the pulley 236 to enable the motor 212 to drive the main gear 238.

A lay plate 242 is affixed to the gear 238. Eyelets 244, 246 (for example, formed of ceramic) are mounted in the lay plate 242 and define passages 244A, 246A. According to some embodiments, the diameter of the eyelet passages 244A, 246A is between about 33 and 178% greater than the outer diameter of the conductor members 11, 13. A through passage 238A is defined in the gear 238 and a through passage 235 is defined in the mount 234.

The second modulator subassembly 250 and the third modulator subassembly 270 are constructed in the same manner as the first modulator subassembly 230 except that the drive shaft gear 252 of the second modulator subassembly 250 has a greater diameter than the gear 232 of the first modulator subassembly 230, and the gear 272 of the third modulator subassembly 270 has a larger diameter than the gear 252 of the second modulator subassembly 250. The first, second and third modulator subassemblies 230, 250, 270 are arranged in series along the path of the conductor members 11, 13 as shown.

The conductor members 11, 13 are routed from the passages 211A, 213A, through the passages 244A, 246A, through the eyelets 264, 266 (FIG. 4) of the second modulator subassembly 250, through the eyelets 284, 286 (FIG. 4) of the third modulator subassembly 270, and out of the modulator 200.

As the conductor members 11, 13 are conveyed (e.g., drawn by the twinner station 140) through the lay plates 242, 262, 282, the lay plates 242, 262, 282 are rotated about the axis A-A. More particularly, the controller 290 operates the motor 212 to rotate the lay plates 242, 262, 282 via the drive shaft 220, the pulleys 232, 252, 272, and the drive belts 240, 260, 280. The lay plates 242, 262, 282 are rotationally reciprocated or oscillated in both a clockwise direction C and a counter clockwise direction D (FIG. 4). In doing so, the lay plates 242, 262, 282 serve as engagement members to add or remove twist from the pair of conductor members 11, 13. That is, the lay plates 242, 262, 282 rotate or de-rotate the conductor members 11, 13 about one another about the axis A-A. By varying the rotational positions of the lay plates 242, 262, 282 and thereby the conductor members 11, 13 as the conductor members 11, 13 pass through the lay plates, the modulator 200 purposefully varies or modulates the degree of rotation of the conductor members 11, 13 about one another at the exit of the modulator 200.

The conductor members 11, 13 exit the modulator 200 as a pretwisted wire pair 3A. The pretwist of the pretwisted wire pair 3A may be positive (i.e., in the same direction as the twist of the twisted pair 3), zero or negative (i.e., in a direction opposite the twist of the twisted pair 3). For example, for a first lengthwise segment of the wire pair 3A, the conductor members may be twisted clockwise about one another, followed by a second segment twisted more tightly clockwise, followed by a third segment twisted clockwise but less tightly, followed by a fourth segment twisted counterclockwise, and so forth. The segments themselves and the transitions between the segments may vary smoothly and continuously. The mean twist of the pretwisted wire pair 3A may also be positive, zero or negative.

The controller 290 may be programmed with a modulation sequence that dictates the operation of the motor 212. The controller 290 may be provided with a display and input device (e.g., a touchscreen) 292 to program the controller 290 and to set and review parameters. The modulation sequence may be random or based on an algorithm. According to some embodiments, the positions of the lay plates 242, 262, 282 are constantly and continuously varied. In accordance with the modulation sequence, the controller 290 controls the speed and direction of the motor and the angular distance or the number of turns in each direction.

The controller 290 may track the linear speed of the conductor members 11, 13 (i.e., the line speed) using the encoder 170 which may be a line speed encoder conventionally associated with the twinner station 140 or the payoff station 110, for example. The controller 290 may also monitor the speed of a motor of the payoff station 110, the motor 212 and/or a motor of the twinner station 140. The controller 290 may be programmed to stop or trip off the payoff station 110, the twinner station 140 and/or the motor 212 if an overtension condition is sensed in the line by appropriate sensors.

The particular modulation sequence employed will depend on the desired twist modulation for the twisted pair 3. The modulation sequence employed may depend on the operation of the twinner station 140. In accordance with some embodiments, the mean twist of the pretwisted wire pair 3A is zero. According to some embodiments, the pretwist imparted to the wire pair to form the pretwisted wire pair 3A varies across an absolute range of at least 0.5% of the nominal twist length of the finished twisted pair 3. According to some embodiments, the pretwist imparted to the wire pair to form the pretwisted wire pair 3A varies across an absolute range of between about 1 and 5% of the nominal twist length of the finished twisted pair 3.

Figure 9:
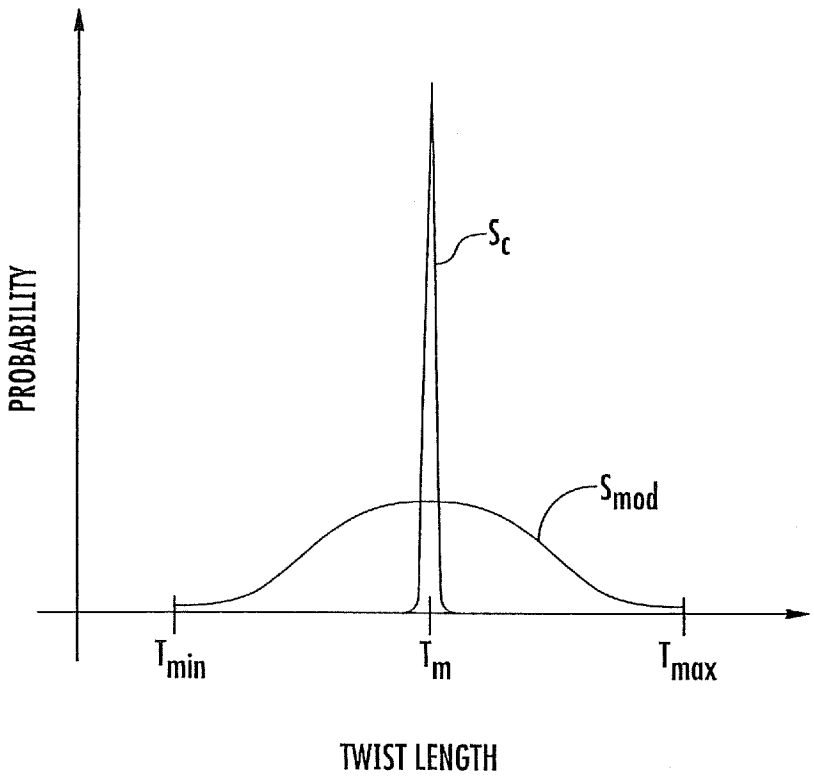
FIG. 9 is a graph illustrating a lay length distribution corresponding to a modulation scheme in accordance with embodiments of the present invention and a lay length distribution corresponding to a wire pair twist scheme in accordance with the prior art.

FIG. 9 graphically illustrates the lay length distribution of a modulation scheme in accordance with embodiments of the present invention as compared to that of a conventional wire pair twist scheme. In the case of the conventional wire pair twist scheme, as represented by the curve $S_c$, the distribution of twist length (e.g., twists per inch) along the length of the cable will vary only slightly from a prescribed mean twist length $T_m$, such variation resulting unintentionally from tolerances in the apparatus and execution of the process. In the scheme according to embodiments of the present invention, represented by the curve $S_{mod}$, the distribution of twist length along the length of the cable varies according to a purposefully wide range. The distribution of the curve $S_{mod}$ varies from a minimum twist length $T_{min}$ to a maximum twist length $T_{max}$. While the distribution as shown is generally a bell-shaped curve, the distribution may be tailored as desired by appropriately programming and selecting the modulation sequence.

Figure 10:
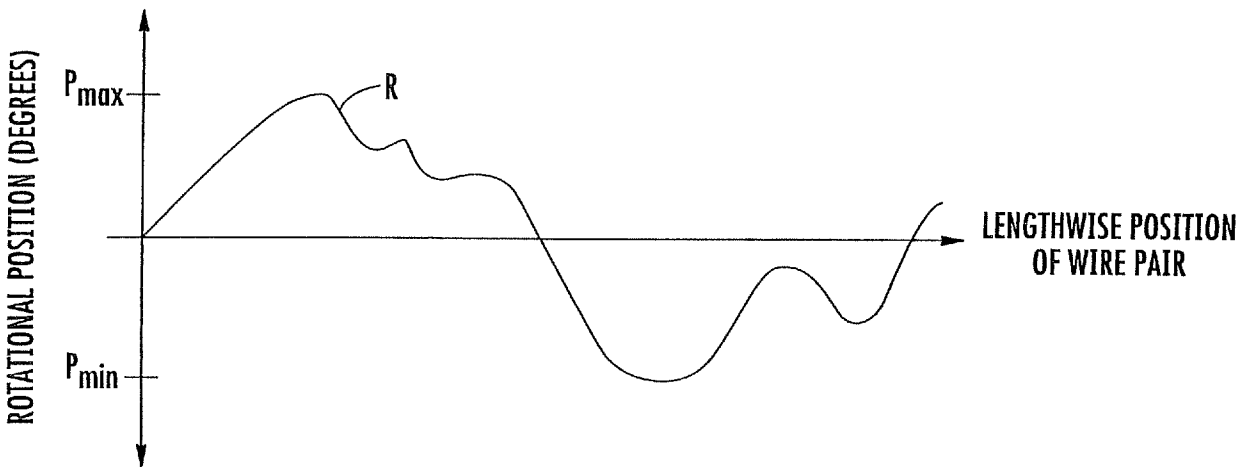
FIG. 10 is a graph illustrating an exemplary modulation sequence in accordance with embodiments of the present invention.

FIG. 10 graphically illustrates an exemplary modulation sequence of the lay plate 242 in accordance with embodiments of the present invention. The curve R represents the rotational position of the lay plate as a function of the location along the length of the wire pair passing therethrough. The rotational position as illustrated varies between a maximum rotational position $P_{max}$, which may correspond to the minimum twist length $T_{min}$ of FIG. 9, and a minimum rotational position $P_{min}$, which may correspond to the maximum twist length of $T_{max}$ of FIG. 9. According to some embodiments, the rotational distance from $P_{min}$ to $P_{max}$ is between about 1080 and 2160 degrees. The lay plates 262, 282 are correspondingly positioned as a function of the lengthwise position of the wire pair but their positions are scaled as a result of the different gear ratios (i.e., resulting from the larger diameter gears 252, 272). According to some embodiments, the midpoint between the rotational positions $P_{max}$ and $P_{min}$ corresponds to the zero twist position of the wire pair (i.e., the position where no twist is present between the guide plate 210 and the lay plate 242). According to some embodiments, the rotational position $P_{min}$ or the rotational $P_{max}$ corresponds to the zero twist position of the wire pair.

Notably, because the gears 232, 252, 272 have different diameters, the lay plates 242, 262, 282 will rotate at different rates and angular distances and thereby impart different amounts of twist to the wire pair 3A. In this manner, twist can be imparted increasingly as the conductor members 11, 13 pass through the modulator 200 and/or more gradually than if fewer lay plates were employed to impart the same amount of twist using a faster rate of rotation for a given line speed.

Referring again to FIG. 3, the pretwisted wire pair 3A passes from the modulator 200 to the twinner station 140. The twinner station 140 may be of any suitable construction and may be of conventional design. Suitable twinners are available from Kinrei of Japan.

The twinner station 140 includes a frame or housing 142 and a bow 152 mounted on hubs 146, 148 for rotation in a direction T. The pretwisted wire pair 3A passes through the hub 146, around a pulley 150, and along an arm of the bow 152. As the bow 152 rotates about the pulley 150, it imparts a twist to the wire pair 3A in known manner thereby converting the pretwisted wire pair 3A to a twisted wire pair 3B. The twisted wire pair 3B continues around a second pulley 156 and onto a reel 158. As the bow 152 rotates about the pulley 156, it imparts a second twist to the twisted wire pair 3B, thereby converting the twisted wire pair 3B to the wire pair 3.

According to some embodiments, the twinner station 140 (and, more particularly, the bow 152 and the pulleys 150, 156) imparts twist to the pretwisted wire pair 3A at a rate of at least two twists/inch. According to some embodiments, the twinner station 140 imparts twist to the pretwisted wire pair 3A at a rate (which may be constant) in the range of from about two to three twists/inch. According to some embodiments, the rate of twist per unit length (e.g., twists/inch) provided by the twinner station 140 is substantially constant.

Notably, the twist imparted by the bow 152 and the pulleys 150, 156 is merely additive to the twist (positive and/or negative) in the pretwisted wire pair 3A. Therefore, the twist modulation present in the pretwisted wire pair 3A carries through to the twisted wire pair 3B and the ultimate twisted wire pair 3.

The twisted wire pair 3 may thereafter be incorporated into a multi-pair cable, jacketed and/or otherwise used or processed in conventional or other suitable manner.

Figure 6:
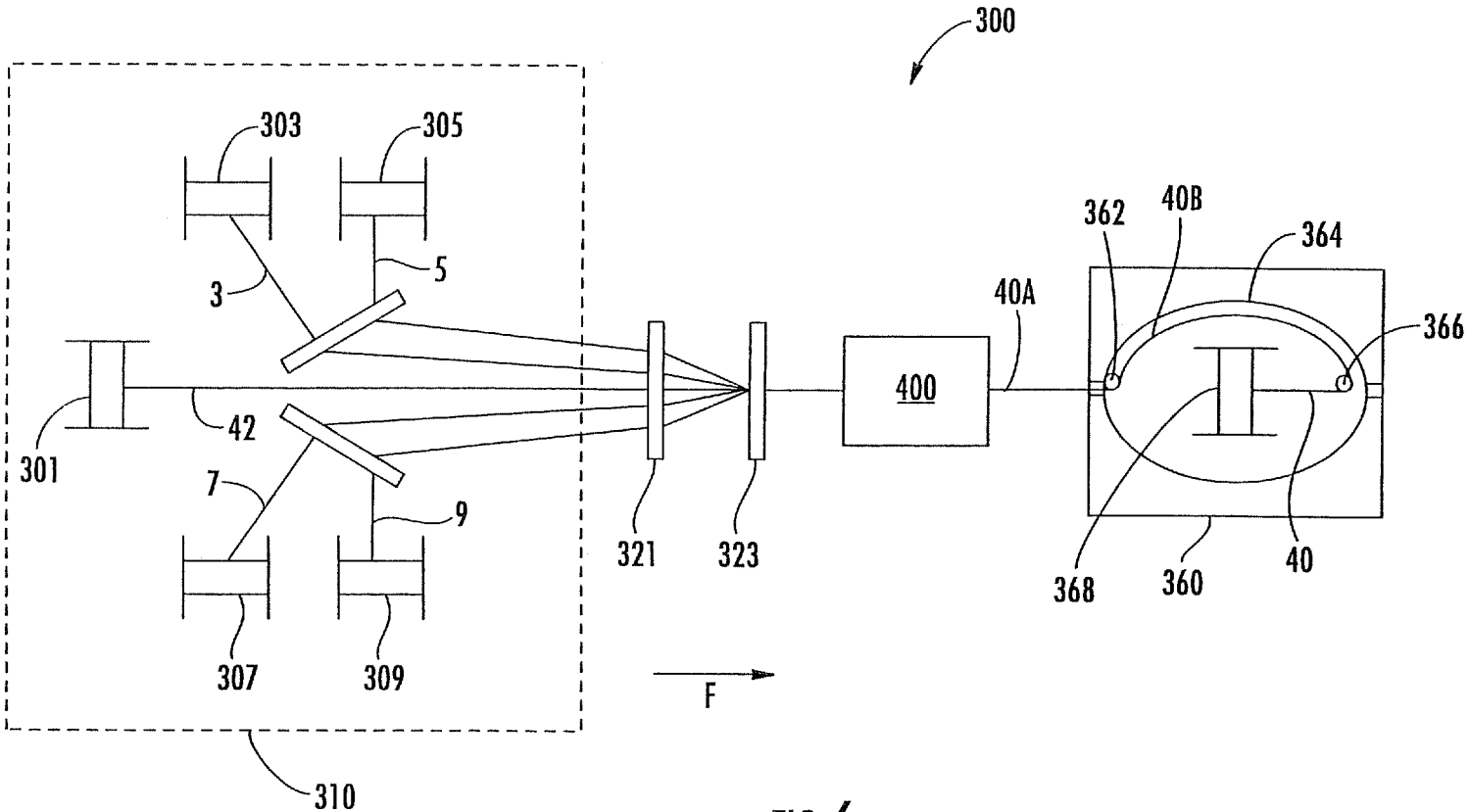
FIG. 6 is a schematic view of a core twisting apparatus according to embodiments of the present invention.

With reference to FIG. 6, a core twisting apparatus 300 according to embodiments of the present invention is shown therein. The core twisting apparatus 300 may be used to form the core 40 having modulated strand core length. The core twisting apparatus 300 includes a wire pair payoff station 310, guide plates 321, 323, a core twist modulator 400, and a buncher or stranding station 360.

The payoff station 310 includes reels 301, 303, 305, 307, 309 from which the separator 42 and the twisted wire pairs 3, 5, 7, 9, respectively, are paid off. The twisted wire pairs 3, 5, 7, 9, and the separator 42 are directed through the guide plates 321, 323 and to the core twist modulator 400.

Figure 7:
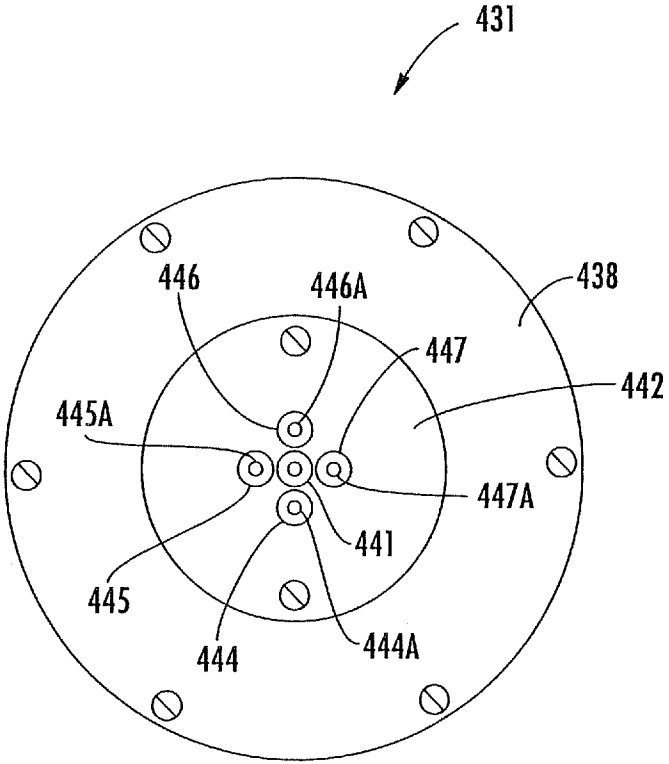
FIG. 7 is a front plan view of a main gear assembly forming a part of a core twist modulator of the apparatus of FIG. 6.

The core twist modulator 400 may be constructed in substantially the same manner as the wire pair twist modulator 200 with suitable modifications to accommodate the more numerous and larger diameter twisted wire pairs 3, 5, 7, 9, and the separator 42. Referring to FIG. 7, a main gear assembly 431 of the modulator 400 is shown therein. The main gear assembly 431 includes a gear 438 corresponding to the gear 238 and a modified lay plate 442. The main gear assembly 431 includes eyelets 441, 444, 445, 446, 447 (e.g., formed of ceramic) defining eyelet passages 441A, 444A, 445A, 446A, 447A adapted to receive the separator 42 and the twisted wire pairs 3, 5, 7, 9, respectively, therethrough. According to some embodiments, the diameters of the eyelet passages 444A, 445A, 446A, 447A are between about 11 and 177% greater than the outer diameters of the twisted wire pairs 3, 5, 7, 9. The lay plate 442 is used in the modulator 400 in place of the lay plates 242, 262, 282. Other suitable modifications may be made as necessary to accommodate the increased number and/or sizes of the lines to be handled by the modulator 400.

The modulator 400 may be operated by a controller in accordance with a suitable modulation sequence to produce a pretwisted strand or core 40A in the same manner as described above with respect to the wire pair twist modulator 200. As discussed above, the modulator sequence may be random or based on an algorithm. According to some embodiments, the positions of the lay plates 442 are constantly and continually varied.

According to some embodiments, the pretwist imparted to the wire pair to form the pretwisted core 40A varies across an absolute range of at least 0.1 twists/inch. According to some embodiments, the pretwist imparted to the wire pair to form the pretwisted core 40A varies across an absolute range of between about 0.1 and 1.0 twists/inch. According to some embodiments, the range of variation of twist rate in the pretwisted core 40A is at least 0.5% of the mean twist rate of the core 40, and according to some embodiments, between about 1 and 10%.

The pretwisted core 40A thereafter passes to the buncher station 360. At the buncher station 360, the pretwisted core 40A is converted to a twisted core 40B by a rotating bow 364 and a first pulley 362. More particularly, the twisted pairs 3, 5, 7, 9 are twisted about one another in a manner commonly referred to as "bunching". The twisted core 40B is thereafter converted (by further twisting/bunching) to the ultimate twisted core 40 by the bow 364 and a second pulley 366 and taken up onto a reel 368.

According to some embodiments, the buncher station 360 (and, more particularly, the bow 364 and the pulleys 352, 366) imparts twist to the pretwisted core 40A at a rate of at least 3 inches/twist. According to some embodiments, the buncher stations 360 imparts twist to the pretwisted core 40A at a rate in the range from about 2 to 8 inches/twist. According to some embodiments, the rate of twist per unit length (e.g., twists/inch) provided by the buncher station 360 is substantially constant.

Notably, the twist imparted by the bow 364 and the pulleys 362, 366 is merely additive to the twist (positive and/or negative) in the pretwisted core 40A. Therefore, the twist modulation present in the pretwisted core 40A carries through to the twisted core 40B and the twisted core 40.

The stranded core 40 may thereafter be jacketed or otherwise used or processed in conventional or other suitable manner.

Figure 8:
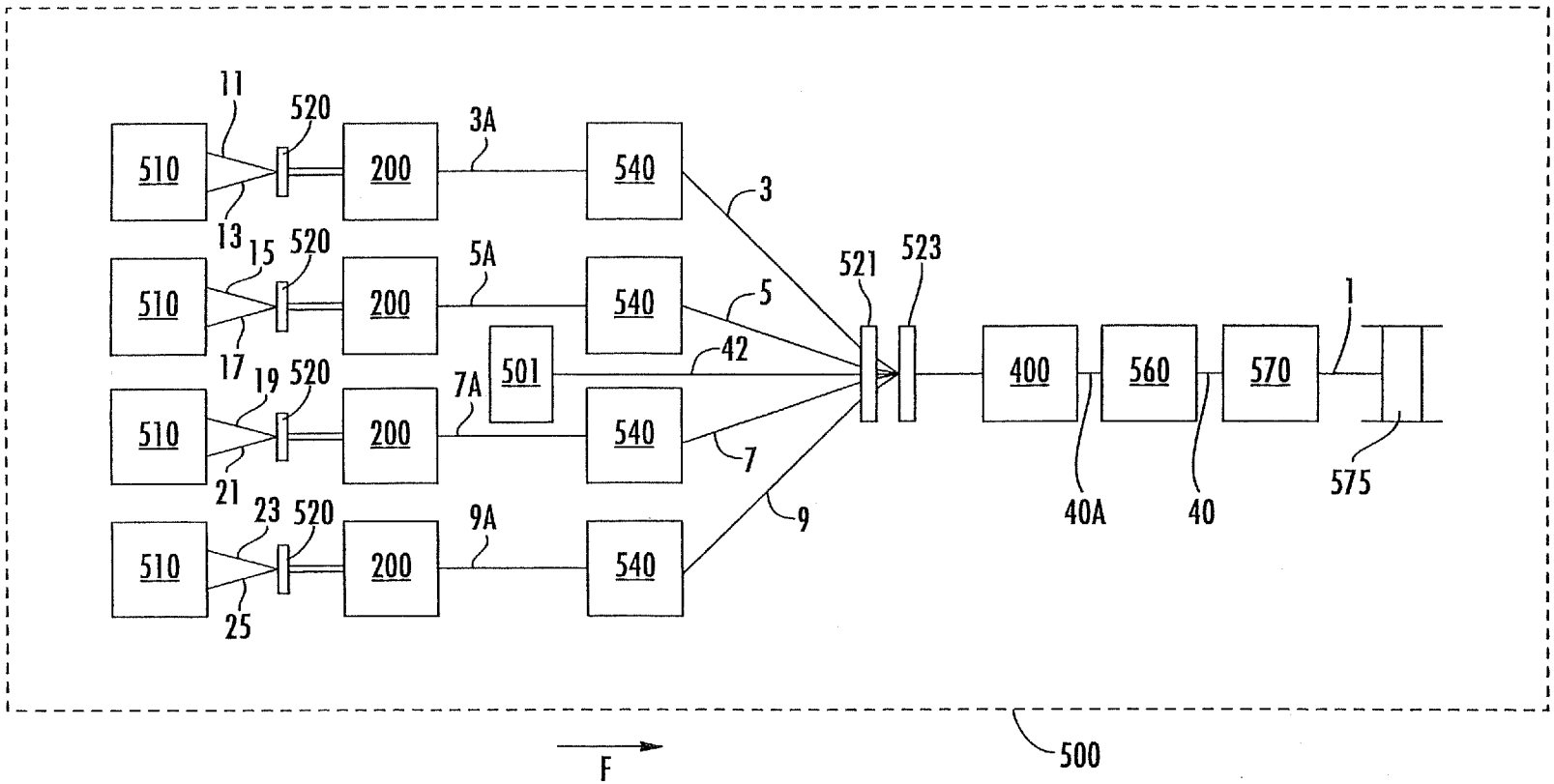
FIG. 8 is a schematic view of a gang twinner apparatus according to embodiments of the present invention.

With reference to FIG. 8, a gang twinner apparatus 500 according to embodiments of the present invention is shown therein, the gang twinner apparatus 500 may be used to form the cable 1, for example. The gang twinner apparatus 500 incorporates the wire pair twist modulation, twinning, core twist modulation, and stranding operations of both the wire pair twisting apparatus 100 and the core twisting apparatus 300.

The gang twinner apparatus 500 includes wire payoff stations 510 corresponding to the wire payoff station 110. The conductor members 11, 13, 15, 17, 19, 21, 23, 25 are routed through respective guide plates 520 and to a respective wire pair twist modulator 200 as shown. The wire pair twist modulators 200 pretwist the respective wire pairs in modulated fashion as described above to convert the wire pairs to pretwisted wire pairs 3A, 5A, 7A, 9A. The pretwisted wire pairs 3A, 5A, 7A, 9A thereafter pass to respective twinner stations 540 corresponding generally to the twinner station 140, which convert the wire pairs 3A, 5A, 7A, 9A to the twisted wire pairs 3, 5, 7, 9 having modulated twist lengths as described herein.

The separator 42 is paid off from a payoff station 501. The separator 42 and the twisted wire pairs 3, 5, 7, 9 are routed through guide plates 521, 523 and to the core twist modulator 400. The core twist modulator 400 converts the separator 42 and the twisted wire pairs 3, 5, 7, 9 to the modulated pretwisted core 40. The pretwisted core 40A is passed through a buncher 560 corresponding to the buncher station 360, which converts the pretwisted core 40A to the core 40.

The core 40 is thereafter passed through a jacketing station 570 where the jacket 2 is applied over the core 40. The jacketing station 570 may be, for example, an extrusion production line. Suitable jacketing lines include those available from Rosendahl of Australia. The jacketed cable 1 may thereafter be taken up on a reel 575.

The various components of the apparatus 500 may form a continuous line process. Alternatively, some of the operations and/or components may be separated from others. For example, the jacketing station may be a separate apparatus not in line with the remainder of the apparatus 500.

Various modifications may be made to the apparatus and methods described above. For example, other or additional modulation devices may be employed. The modulator 200 and/or the modulator 400 may use more or fewer modulator subassemblies and lay plates. The modulator subassemblies 230, 250, 270 may be independently controlled and the rotation rates thereof may not be scaled proportionally. The methods and apparatus for modulating the twist of the twisted wire pairs and the methods and apparatus for modulating the twist of the core may be used separately.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An apparatus for forming a cabling media using a wire pair including first and second conductor members, each of the first and second conductor members including a respective conductor and a respective insulation cover surrounding the conductor thereof, the apparatus including:

a) a wire pair twist modulator adapted to impart a purposefully varied pretwist to the wire pair; and b) a wire pair twisting device downstream of the wire pair twist modulator, wherein the wire pair twisting device is adapted to impart additional twist to the wire pair, wherein the apparatus is adapted to twist the first and second conductor members about one another to form a twisted wire pair having a twist length that purposefully varies along a length of the twisted wire pair, and wherein the twist length purposefully varies by no more than about +/−0.05 inches from a mean twist length of the twisted wire pair.

2. The apparatus of claim 1 wherein the wire pair twist modulator is adapted to impart each of a positive twist and a negative twist to the wire pair.

3. The apparatus of claim 1 including an engagement member adapted to engage the wire pair and rotationally oscillate about a twist axis.

4. The apparatus of claim 3 wherein the engagement member includes at least one eyelet to receive the first and second conductor members.

5. The apparatus of claim 3 including a first eyelet to receive the first conductor member and a second eyelet to receive the second conductor member.

6. The apparatus of claim 3 including a plurality of serially arranged engagement members, wherein each of the engagement members is adapted to engage the wire pair and rotationally oscillate about a respective twist axis.

7. The apparatus of claim 6 wherein the wire pair twist modulator is adapted to rotationally oscillate the plurality of engagement members different distances.

8. The apparatus of claim 1 wherein the wire pair twisting device is adapted to impart a substantially constant rate of twist per unit length to the wire pair.

9. The apparatus of claim 1 including a controller that substantially randomly varies the twist length of the wire pair.

10. The apparatus of claim 1 including a controller that varies the twist length of the wire pair in accordance with an algorithm.

11. The apparatus of claim 1 including a supply of the first and second conductor members.

12. An apparatus for forming a cabling media using a wire pair including first and second conductor members, each of the first and second conductor members including a respective conductor and a respective insulation cover surrounding the conductor thereof, wherein the apparatus is adapted to twist the first and second conductor members about one another to form a twisted wire pair having a twist length that purposefully varies along a length of the twisted wire pair, wherein the apparatus is further adapted to twist the twisted wire pair and a second twisted wire pair about one another to form a twisted core having a length such that a twist length of the twisted core purposefully varies along the length of the twisted core.

13. The apparatus of claim 12 including:

a) a core twist modulator adapted to impart a purposefully varied pretwist to the twisted wire pair and to the second twisted wire pair; and b) a core twisting device downstream of the core twist modulator, wherein the core twisting device is adapted to impart additional twist to the twisted wire pair and the second twisted wire pair.

14. The apparatus of claim 13 wherein the core twisting device is adapted to impart a substantially constant rate of twist per unit length to the twisted wire pair and the second twisted wire pair.

15. The apparatus of claim 1 including a jacketing device adapted to apply a jacket about the twisted wire pair.

16. An apparatus for forming a cabling media using a wire pair including first and second conductor members, each of the first and second conductor members including a respective conductor and a respective insulation cover surrounding the conductor thereof, wherein the apparatus is adapted to twist the first and second conductor members about one another to form a twisted wire pair having a twist length that purposefully varies along a length of the twisted wire pair, wherein the twist length purposefully varies by no more than about +/−0.05 inches from a mean twist length of the twisted wire pair, the apparatus further adapted to twist the twisted wire pair and a second twisted wire pair about one another to form a twisted core having a length such that a twist length of the twisted core purposefully varies along the length of the twisted core, and further including:

a) a wire pair twist modulator adapted to impart a purposefully varied pretwist to the wire pair, the wire twist modulator including an engagement member adapted to engage the wire pair and rotationally oscillate about a twist axis and a controller to control the oscillation of the engagement member;

b) a wire pair twisting device downstream of the wire pair twist modulator, wherein the wire pair twisting device is adapted to impart additional twist to the wire pair, and wherein the wire pair twisting device is adapted to impart a substantially constant rate of twist per unit length to the wire pair;

c) a core twist modulator adapted to impart a purposefully varied pretwist to the twisted wire pair and to the second twisted wire pair; and d) a core twisting device downstream of the core twist modulator, wherein the core twisting device is adapted to impart additional twist to the twisted wire pair and to the second twisted wire pair, and wherein the core twisting device is adapted to impart a substantially constant rate of twist per unit length to the twisted wire pair and the second twisted wire pair.

* * * * *